US010973295B2

(12) United States Patent
Chaouch

(10) Patent No.: US 10,973,295 B2
(45) Date of Patent: Apr. 13, 2021

(54) SUITCASE COMPRISING A LID THAT OVERLAPS A SIDE WALL

(71) Applicant: Stratic Lederwaren Jacob Bonifer GmbH, Rodgau (DE)

(72) Inventor: Karim Chaouch, Hanau-Kesselstadt (DE)

(73) Assignee: Stratic Lederwaren Jacob Bonifer GmbH, Rodgau (DE)

( * ) Notice: Subject to any disclaimer, the term of this patent is extended or adjusted under 35 U.S.C. 154(b) by 245 days.

(21) Appl. No.: 16/007,185

(22) Filed: Jun. 13, 2018

(65) Prior Publication Data

US 2018/0360182 A1 Dec. 20, 2018

(30) Foreign Application Priority Data

Jun. 19, 2017 (EP) ..... 17176736

(51) Int. Cl.

| | |
|---|---|
| ***A45C 13/10*** | (2006.01) |
| ***A45C 5/03*** | (2006.01) |
| ***A45C 13/36*** | (2006.01) |
| ***A45C 3/00*** | (2006.01) |
| ***A45C 13/02*** | (2006.01) |
| ***A45C 5/14*** | (2006.01) |
| *A45C 7/00* | (2006.01) |

(52) U.S. Cl.

CPC ..... *A45C 13/103* (2013.01); *A45C 5/03* (2013.01); *A45C 13/36* (2013.01); *A45C 5/14* (2013.01); *A45C 7/0054* (2013.01); *A45C 13/02* (2013.01); *A45C 2003/008* (2013.01); *A45C 2005/035* (2013.01)

(58) Field of Classification Search

CPC ... A45C 13/103; A45C 2005/035; A45C 5/03; A45C 5/14; A45C 13/36

See application file for complete search history.

(56) References Cited

U.S. PATENT DOCUMENTS 3,768,610 A * 10/1973 Housel ..... A45C 3/00 190/113
5,501,324 A * 3/1996 Franklin ..... A45C 3/004 206/279
9,961,975 B1 * 5/2018 Tong ..... A45C 5/03

(Continued)

FOREIGN PATENT DOCUMENTS

CN 202 618 637 U 12/2012
DE 10 2007 043 898 A1 4/2009

(Continued)

*Primary Examiner* — James N Smalley
*Assistant Examiner* — Jennifer Castriotta
(74) *Attorney, Agent, or Firm* — Collard & Roe, P.C.

(57) ABSTRACT

In a suitcase including a suitcase body that is delimited by a back wall and by side walls that adjoin the back wall and are arranged on two opposing narrow and long sides of the suitcase body in each case, a folding lid is formed on at least one side of the suitcase body. The lid can be connected to the suitcase body by a zip fastener. One side wall of the suitcase body includes a recess in which an overlapping segment of the lid engages such that the overlapping segment forms the side wall of the suitcase body at least in part. The suitcase body (2) may include a limiting element in the recess, by which element luggage contents are prevented from falling out of the suitcase.

9 Claims, 9 Drawing Sheets

(56) References Cited

U.S. PATENT DOCUMENTS

| | | | | |
|---|---|---|---|---|
| 2004/0007433 | A1 | 1/2004 | Godshaw et al. | |
| 2012/0024850 | A1* | 2/2012 | Mazzan | A45C 13/06 220/200 |
| 2012/0048849 | A1* | 3/2012 | Crandall | A45C 7/0063 220/4.03 |
| 2014/0131964 | A1* | 5/2014 | Farrelly | A45C 13/103 280/79.2 |
| 2014/0299430 | A1* | 10/2014 | Tseng | A45C 5/02 190/107 |
| 2014/0369628 | A1 | 12/2014 | Tzortzis | |
| 2015/0021133 | A1* | 1/2015 | Xu | A45C 5/03 190/18 A |
| 2016/0213110 | A1 | 7/2016 | Wong et al. | |
| 2018/0014614 | A1* | 1/2018 | Marshall | A45C 13/103 |

FOREIGN PATENT DOCUMENTS

| | | | |
|---|---|---|---|
| DE | 10 2015 003 739 | A1 | 9/2015 |
| FR | 2 777 757 | A1 | 10/1999 |
| GB | 2 415 955 | A | 1/2006 |

* cited by examiner

SUITCASE COMPRISING A LID THAT OVERLAPS A SIDE WALL

CROSS REFERENCE TO RELATED APPLICATIONS

Applicant claims priority under 35 U.S.C. § 119 of European Application No. 17176736.1 filed on Jun. 19, 2017, the disclosure of which is incorporated by reference.

BACKGROUND OF THE INVENTION

1. Field of the Invention

The invention relates to a suitcase comprising a suitcase body having side walls, and comprising a folding lid that is formed on at least one side of the suitcase body, one side wall of the suitcase comprising a recess in which an overlapping segment of the lid engages.

2. Description of the Related Art

A suitcase consists of two parts that can be interconnected by means of a zip fastener. In order to protect the contents of the suitcase against forces acting thereon and to in addition keep the shape of the suitcase stable, the suitcase either comprises a hard shell structure or has a stabilizing frame that is provided with protective reinforcements at least in part. Said reinforcements are generally integrated into the base of the suitcase and into the side of the suitcase opposite the base. At least two casters are generally fastened on the base, it being possible for the suitcase to be carried using a simple carrying handle, and to be pulled using an extendable handle if the casters are intended to be used. Known suitcases are disclosed in DE 10 2015 003 739 A1 or DE 10 2007 043 898 A1 for example.

In particular in the case of soft material suitcases, the main body of which is covered in a soft material such as leather or fabric, a skeleton protecting the contents, or corresponding reinforcements arranged on the suitcase sides, are very important. Otherwise, external forces acting on the suitcase may result in damage to the suitcase contents.

A disadvantage of a hard-shell suitcase is the high weight and the rigidity, resulting from the hard shells that consist of plastics material or metal. The same also applies to a soft material suitcase which, despite having a lower weight than a hard-shell suitcase, nonetheless has a high empty weight on account of the main body or the reinforcements.

SUMMARY OF THE INVENTION

The object of the invention is that of providing an alternative suitcase that has a low empty weight and nonetheless adequately protects the suitcase contents.

The object is achieved by a suitcase according to the invention. Developments and advantageous embodiments of the invention are set out below.

According to the invention, a suitcase comprising a suitcase body is provided, which suitcase body is delimited by a back wall and by side walls that adjoin said back wall and are arranged on two opposing narrow and long sides of the suitcase body in each case, and said suitcase comprising a folding lid that is formed on at least one side of the suitcase body and can be connected to the suitcase body by means of a zip fastener, one side wall comprising a recess in which an overlapping segment of the lid engages such that the overlapping segment forms the side wall of the suitcase body at least in part. The suitcase according to the invention is preferably a soft material suitcase.

Structure-reinforcement and frame-reinforcement elements (such as steel frames as a framework skeleton on the individual suitcase sides) can advantageously be substantially dispensed with in the invention, the structure-reinforcing characteristics being achieved by the design of the overlapping segment and the engagement thereof in the recess. Owing to the recess, the side wall has only low stability and does not provide sufficient protection against external forces acting thereon. However, both the stability of the side wall and protection are ensured by means of the overlapping segment compensating for the missing part of the side wall. The weight of the suitcase body can thus be reduced.

The suitcase body is advantageously designed such that the edges that extend from the narrow or long sides towards the lid are curved outwardly. That is to say that in particular the suitcase corners that are formed by the narrow sides and long sides together may be convex. The suitcase can nonetheless be stacked, and is less sensitive to impacts on account of the rounded edges. In one embodiment, the overlapping segment may be curved outwardly so as to correspond geometrically to the rounded edges of the suitcase body and to fit geometrically into the recess in the side wall and cover said recess. This is advantageous because the stackability of the suitcase is not adversely affected.

The zip fastener connects the lid to the suitcase body, it being possible for the zip fastener to be provided on three sides of the suitcase body. The lid may be movably formed on at least one side of the suitcase body. This may be a narrow side or a long side of the suitcase body. It may also be preferable for the lid to be formed on the suitcase body by means of the overlapping segment. In this case, the overlapping segment is in particular formed on the recess of the side wall. The zip fastener may be designed as a separable zip fastener comprising two zip fastener band halves, one band half of the zip fastener extending along an upper edge of the suitcase body that is formed by the side walls and the recess, and a further band half of the zip fastener extending along a lower edge of the lid that is formed by a lid base surface or by the lid base surface and the overlapping segment. For the embodiment in which the lid is formed on the suitcase body, the lid base surface and the overlapping segment form the lower edge along which the band half of the zip fastener extends. In this case, the lid can be moved together with the overlapping segment, and the overlapping segment can be fastened to the suitcase body, in particular to the recess, by means of the zip fastener. It is also possible, however, for the lid to be formed on the suitcase by means of the overlapping segment, such that the lid base surface forms the lower edge along which the band half of the zip fastener extends.

A limiting element may be arranged in the recess. The limiting element can either be already integrated in the suitcase body or, if necessary, clamped in the recess. The limiting element can prevent luggage contents from falling out of the opened suitcase. The limiting element may be designed as a net or as an elastic wall for example.

According to one embodiment, a carrying handle is formed on the overlapping segment. The overlapping segment advantageously overlaps the side wall such that the carrying handle is preferably arranged centrally on the side of the suitcase, such that the suitcase remains balanced when carried and can be carried comfortably.

In order to keep the lid dimensionally stable, it may be advantageous to provide an at least partially peripheral plastics or metal edge reinforcement on the lid. The edge reinforcement may be welting that is sewn to the lid. It has been found that the edge reinforcement in the lid improves the stability and integrity of the suitcase as a whole.

In order to stabilize the carrying handle, a plastics or metal reinforcement that leads onto the carrying handle and surrounds the lid at least in part may be provided in the lid that consists of welting for example.

In one embodiment, dimensionally stabilizing reinforcement elements may be provided in the suitcase body. These may be plastics or metal elements that are in the form of segments and are integrated only at the regions of the suitcase body that are to be reinforced. The reinforcement elements may also be formed as a frame or skeleton. The reinforcement elements may be provided in the rear wall or the sides of the suitcase body, said reinforcement elements being accordingly shaped or cut to size in order to form the recess in the side wall.

It is preferable for a side wall of the suitcase body to be in the form of a structurally rigid base structure that is formed by a stabilizing shell and on which casters are provided. This may also be the side wall that is opposite the side wall comprising the recess.

It is preferable for an openable folded fastener to be provided on the suitcase body, below the zip fastener, at least in part, which folded fastener covers a fabric fold when closed, which fold is exposed when the folded fastener is open. This makes it possible to increase the suitcase volume.

It is possible for a reinforcement element to be provided in the overlapping segment. The reinforcement element arranged in the overlapping segment may be produced from a plastics material or a metal and may be formed as a convex plate. The reinforcement element in the overlapping segment is preferably designed so as to substantially fit into the recess in the side wall. This results in protection of the side wall, despite the recess. It may further be advantageous for the side wall comprising the recess to comprise a reinforcement element at least in part, which element forms, together with a reinforcement element provided in the overlapping segment, a reinforcement that substantially completely covers the relevant side of the suitcase body. This would provide protection that substantially completely covers the side wall.

BRIEF DESCRIPTION OF THE DRAWINGS

The invention will be described in greater detail in the following, with reference to embodiments of the invention that are shown in the drawings. In the drawings.

DETAILED DESCRIPTION OF THE PREFERRED EMBODIMENTS

Figure 5:
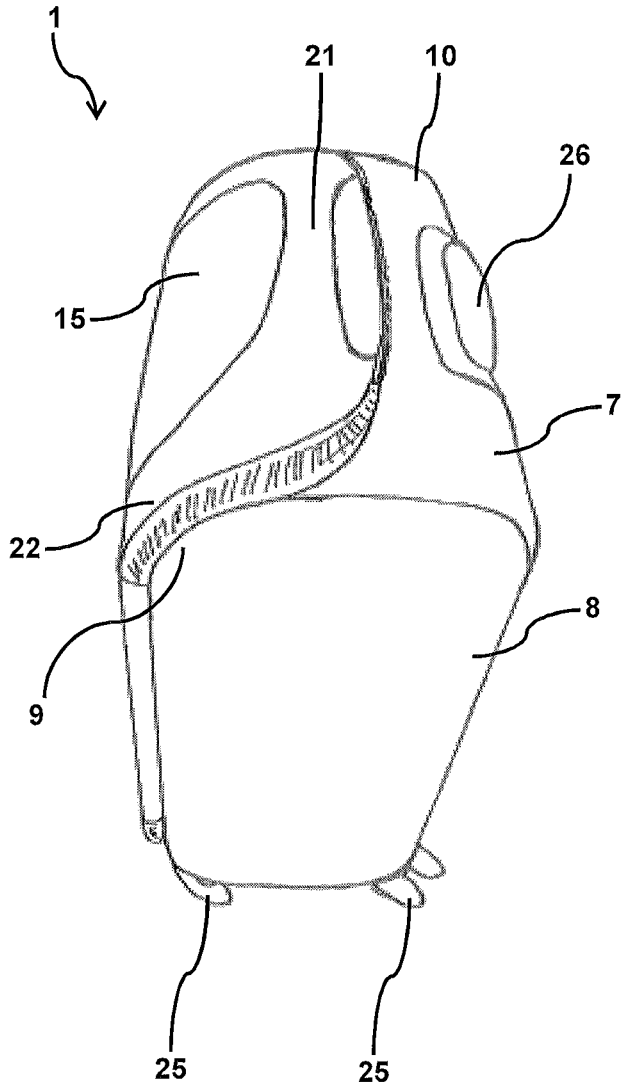
FIG. 5 is a perspective view of a closed suitcase.
Figure 7:
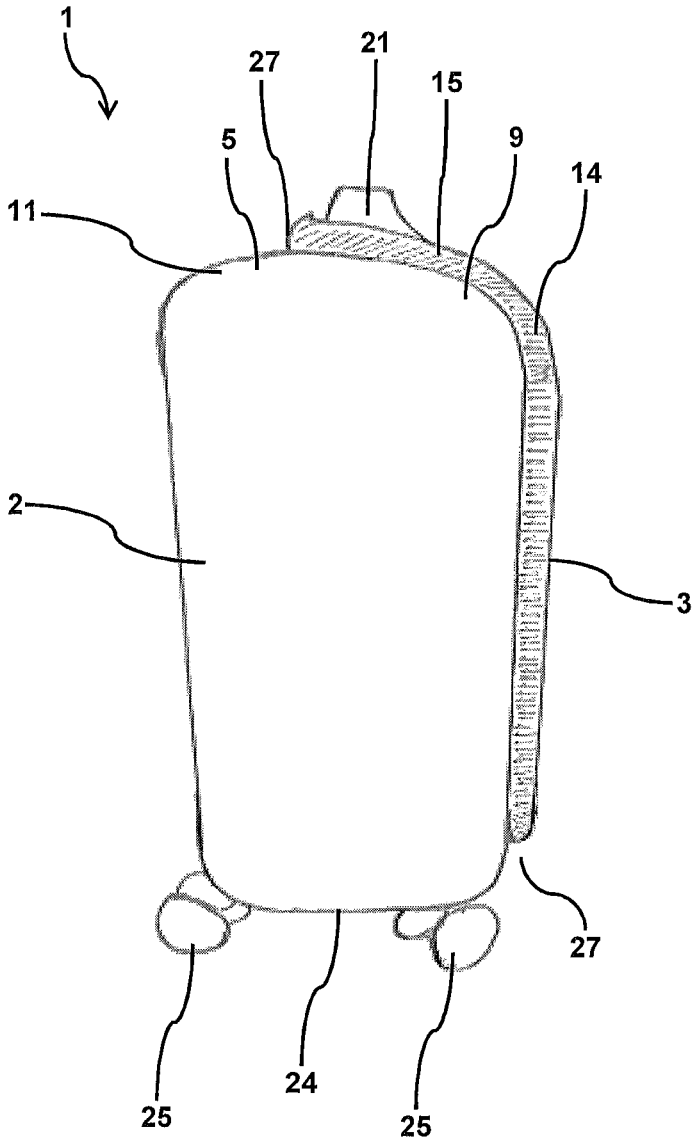
FIG. 7 is a side view of a suitcase comprising a carrying handle arranged on the narrow side.

A suitcase 1 is formed by a suitcase body 2 and a lid 3. The suitcase body 2 comprises a rear wall 4 that is adjoined by four side walls 5 that are oriented so as to be substantially perpendicular to the rear wall 4 and thus define a luggage space 6 in the suitcase body 2. The side walls 5 are arranged on narrow sides 7 and long sides 8 of the suitcase body that are mutually opposing in each case. The long sides 8 comprise rounded corners 9 in the direction of the lid 3 or the rear wall 4. The edges 10 of the narrow sides 7 are convex at least in part and comprise at least one outward bulge, as indicated in FIGS. 5 and 7 for example.

The side wall 5 on the upper face 11 of the suitcase body 2 comprises a recess 12, with the result that the side wall 5 comprising the recess 12 is shorter, like the opposing side wall 5, at least in the region of the recess 12. In order to prevent luggage accommodated in the luggage space 6 from falling out, a limiting element 13 in the form of a net or a structure consisting of a flexible material may be clamped in the recess 12. The limiting element 13 may also be formed as a partition which, if necessary, can be pushed into the suitcase body 2, in particular the side wall 5 comprising the recess 12.

Figure 2:
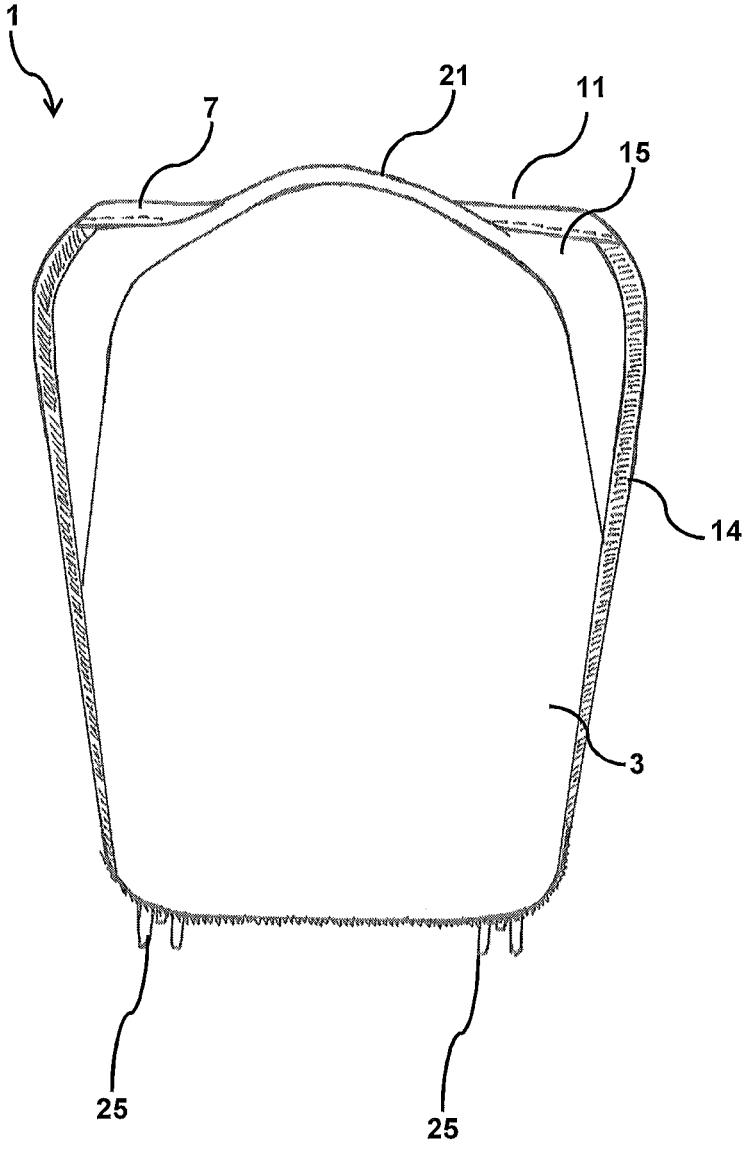
FIG. 2 is a side view of a suitcase comprising a lid formed on the narrow side.
Figure 3:
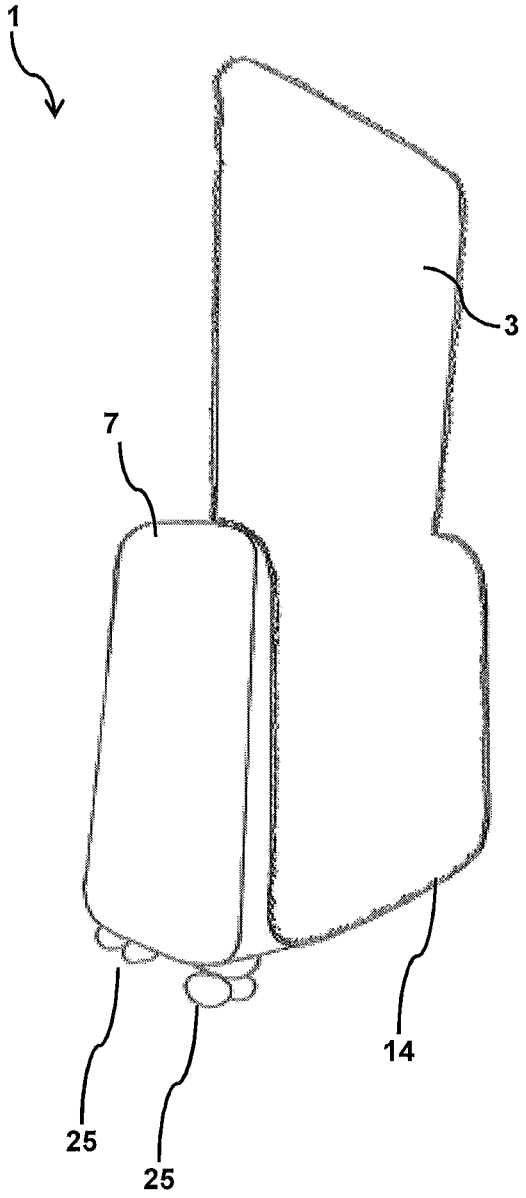
FIG. 3 is a perspective view of an open suitcase comprising a lid formed on the narrow side.

The lid 3 is formed on a long side 8 of the suitcase body 2 and can be connected to the suitcase body 2 by means of a zip fastener 14, the lid 3 being opened via the long side 8. As shown in FIG. 2, the lid 3 may also be movably formed on the narrow side 7 and consequently opened via the narrow side 7. FIG. 3 shows a suitcase 1 when open, the lid 3 being formed on the narrow side 7. The zip fastener 14 is interrupted in the region where the lid 3 is formed on the suitcase body 2. The lid 3 may be hingedly fastened to the suitcase body 2 by means of a fabric band for example.

Figure 4:
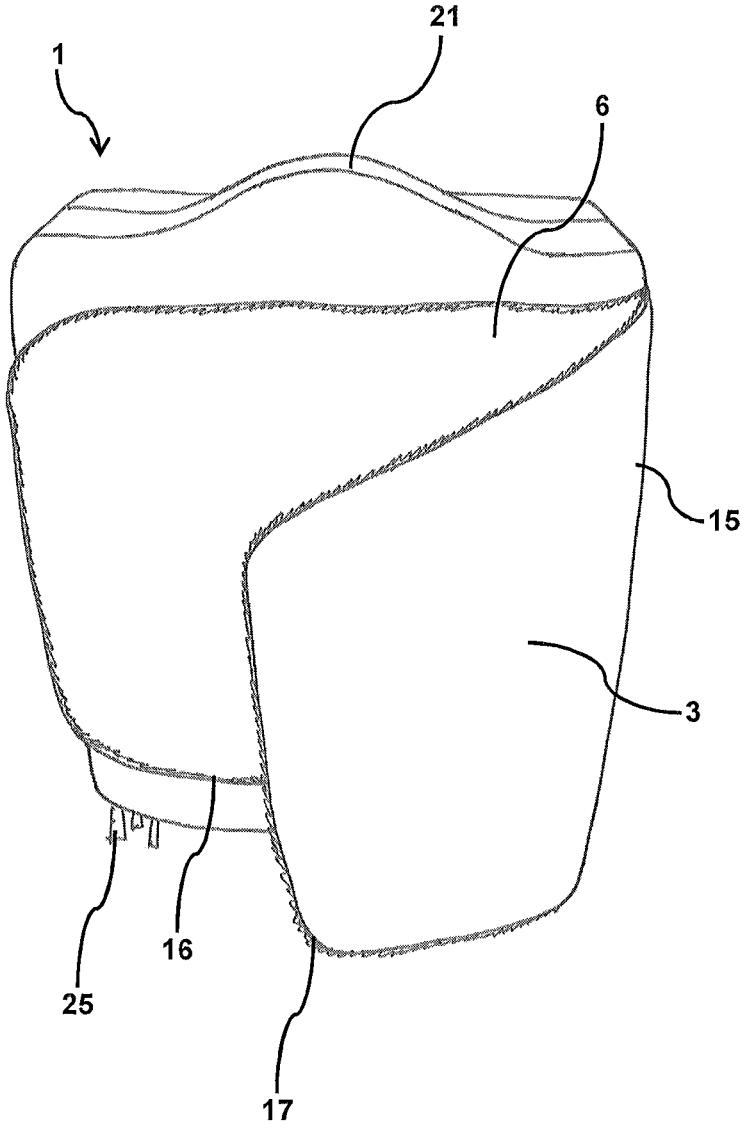
FIG. 4 is a perspective view of an open suitcase comprising an overlapping segment formed on the long side.

The lid 3 comprises an overlapping segment 15 that overlaps a side 7, 8 of the suitcase body 2 and protrudes into the recess 12. The overlapping segment 15 compensates for the region of the side wall 5 that is missing on account of the recess 12, and therefore the overlapping segment 15 forms the side wall 5 of the suitcase body 2 at least in part, and the side 7, 8 of the suitcase body 2 comprising the recess 12 is formed from a part of the side wall 5 and a part of the overlapping segment 15. The overlapping segment 15 may be arranged in the movable part of the lid 3 that is moved over the luggage space 6 of the suitcase body 2 and covers said space. It is also possible, however, for the lid 3 to be formed on the suitcase body 2 on the overlapping segment 15, as indicated in FIGS. 2 and 4. In this case, the overlapping segment 15 is not moved together with the lid 3 when said lid is opened. Nonetheless, the overlapping segment 15 still compensates for the recess 12 in the side wall 5 in this embodiment too.

The zip fastener 14 is formed as a separable zip fastener 14 comprising two band halves 16, 17, one band half 16 being provided on the suitcase body 2 and a further band half 17 being provided on the lid 3. The band half 16 on the suitcase body 2 extends along an upper edge 18 of the suitcase body 2 that is formed by the side walls 5 and the recess 12. The band half 17 on the lid 3 extends along a lower edge 20 of the lid 3 that is formed by a lid base surface 19 and the overlapping segment 15. For the embodiment shown in FIGS. 2 to 4, in which the overlapping segment 15 is formed on the suitcase body 2, the band half 17 of the zip fastener on the lid 3 extends along the lower edge 20 that is formed by the lid base surface 19.

A carrying handle 21 is arranged on the overlapping segment 15, specifically such that the suitcase 1 remains balanced when carried and can be carried comfortably. It is advantageous, for this purpose, for the carrying handle 21 to be provided centrally on the side 7, 8, as indicated in FIG. 7. In order to stabilize the carrying handle 21, a reinforcement (not shown) is integrated in the carrying handle 21, which reinforcement consists for example of a plastics material or metal and is designed as a honeycomb slat in order to save weight. It is also possible, however, for the carrying handle 21 to be provided on the narrow side 7 of the suitcase body 2, as shown in FIG. 4.

The suitcase body 2 is designed such that the corners 9 formed by the narrow and long sides 7, 8 are rounded. The suitcase body may comprise reinforcement elements (not shown) which are integrated in the side walls 5 for example and are provided in the form of U-shaped plastics or metal plates. The side wall 5 comprising the recess 12 comprises a divided plate or individual reinforcement elements that are substantially in the shape of a half U. An outwardly curved reinforcement element (not shown) may also be received in the overlapping segment 15, which element stabilizes the overlapping segment 15 and provides protection against the action of external forces. In the event of the side wall 5 comprising the recess 12 also comprising a reinforcement element which, however, provides protection only in part, owing to the recess 12, the reinforcement element in the overlapping segment 15 supplements the reinforcement element in the side wall 5, such that the side 7, 8 of the suitcase 1 is sufficiently protected against external forces. The reinforcement element in the overlapping segment consists of a plastics material, such as polyethylene, and is formed as a convex plate, so as to correspond geometrically to the rounded corners 9 of the suitcase body 2 and to fit geometrically into the recess 15 in the side wall 5.

Figure 6:
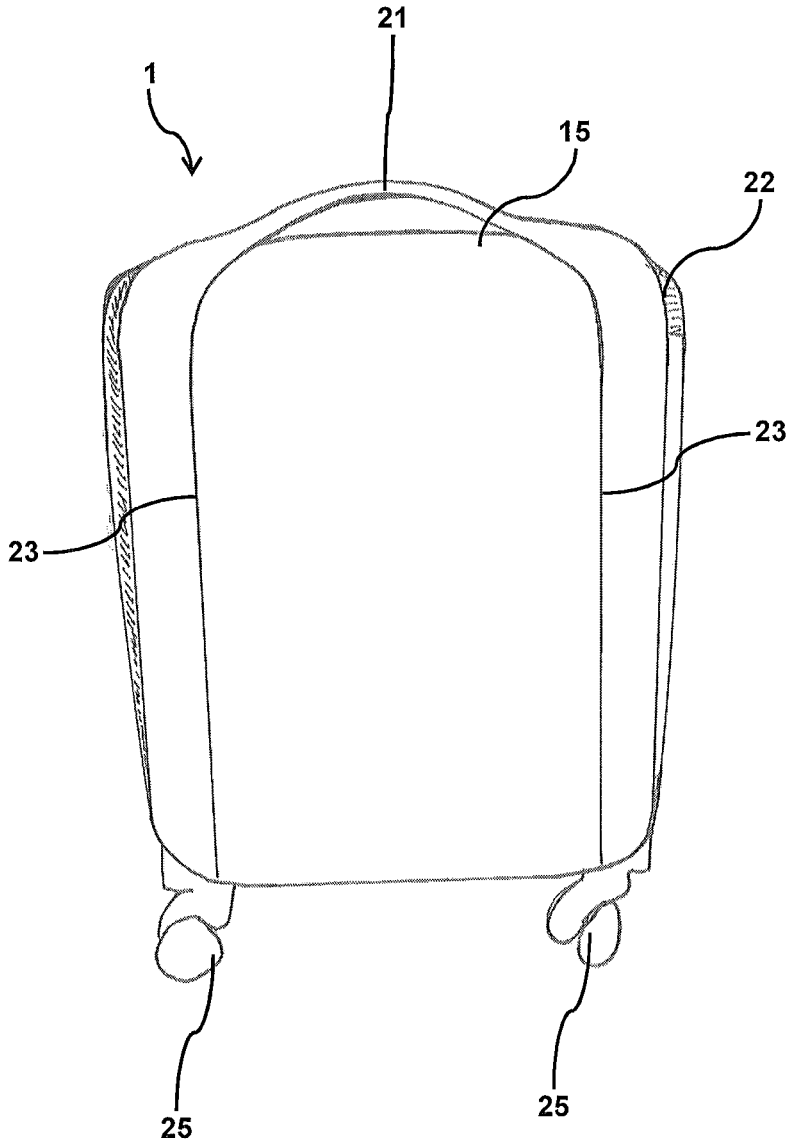
FIG. 6 is a side view of a suitcase comprising reinforcements in the lid.

As can be seen inter alia in FIG. 5, an edge reinforcement 22 extends at least in part along the band half 17 of the zip fastener in the lid 3, which edge reinforcement stabilizes the shape and structure of the lid 3. Since the band half 17 is edge-reinforced at least in part, the zip fastener 14 also has a structuring function that may in particular stabilize, via the overlapping segment 15, the structure of the side wall 5 comprising the recess 12. Additional structure-reinforcement or frame-reinforcement elements can be omitted in the sides 7, 8, as a result of which the weight of the suitcase 1 is reduced. The edge reinforcement 22 may be produced from welting for example and be sewn into the lid 3. A further reinforcement leads onto the carrying handle 21 and surrounds the lid 3 at least in part, as shown in FIG. 6 for example. The reinforcement 23 stabilizes the carrying handle 21 and diverts the tensile forces acting thereon into the suitcase body. Both the reinforcements 22, 23 have a dimensionally stabilizing effect on the lid 3 and prevent the lid 3 from caving in when open.

Figure 1:
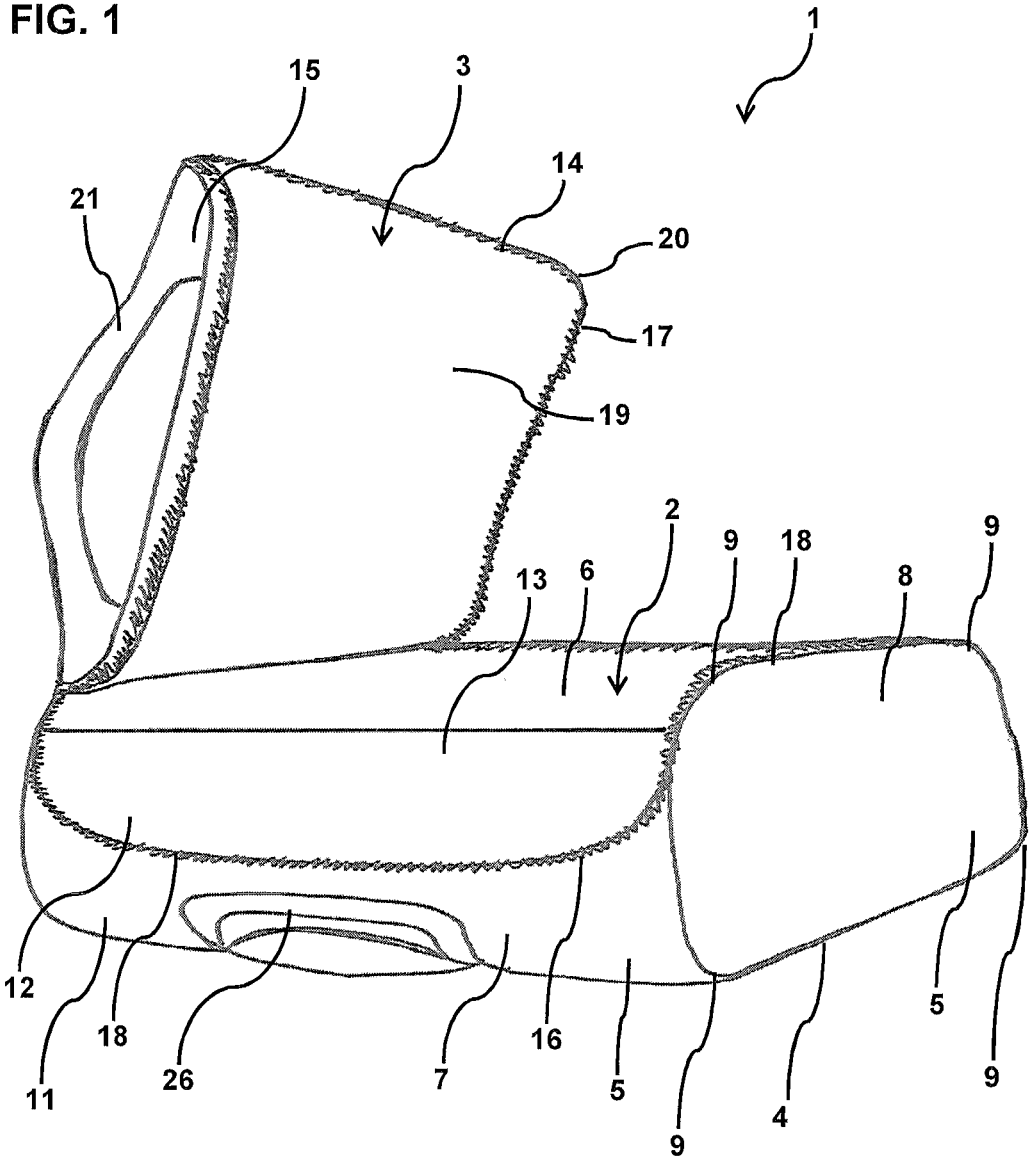
FIG. 1 is a perspective view of an open suitcase comprising a lid formed on the long side.
Figure 8:
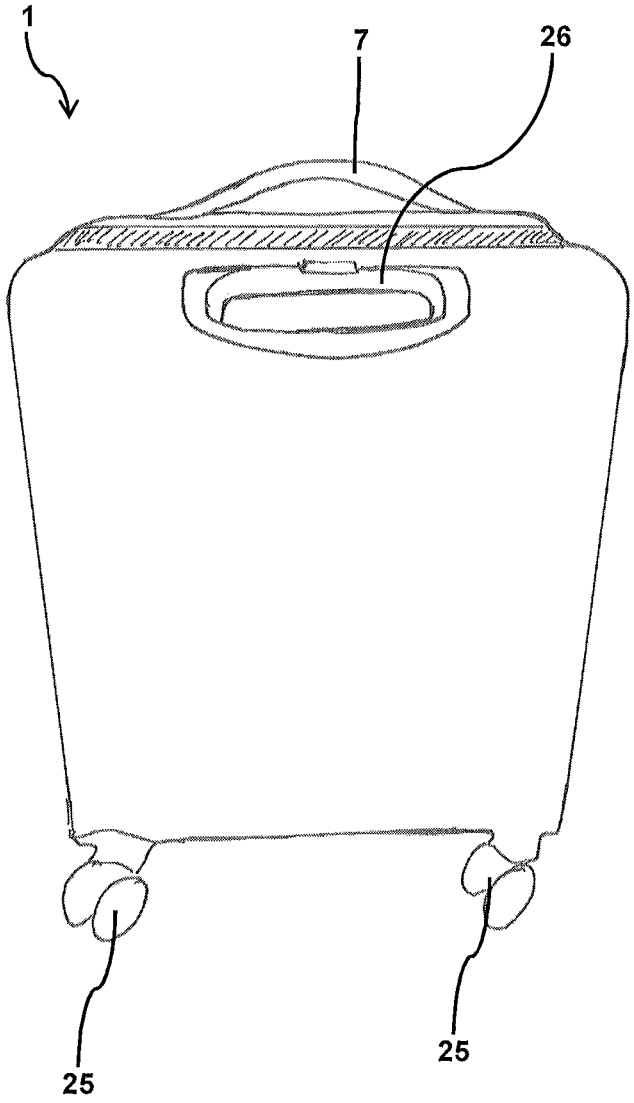
FIG. 8 is a side view of a suitcase comprising a handle provided in the rear wall.

It can be seen in FIG. 7 that a side wall 5 is provided on a lower face 24 of the suitcase body 2 as a curved trough or shell, which trough or shell forms a base structure on which casters 25 are provided. In this case, depending on the design of the suitcase 1, two or more casters 25 may be arranged on the base structure. The base structure may be formed as a structurally rigid plastics shell. In order to move the suitcase 1 using the casters 25, a handle 26 is provided, comprising a telescopic bar (not shown) that can be extended and lowered into the rear wall 4 of the suitcase body 2, as shown in FIGS. 1, 5 and 8 for example.

Figure 9:
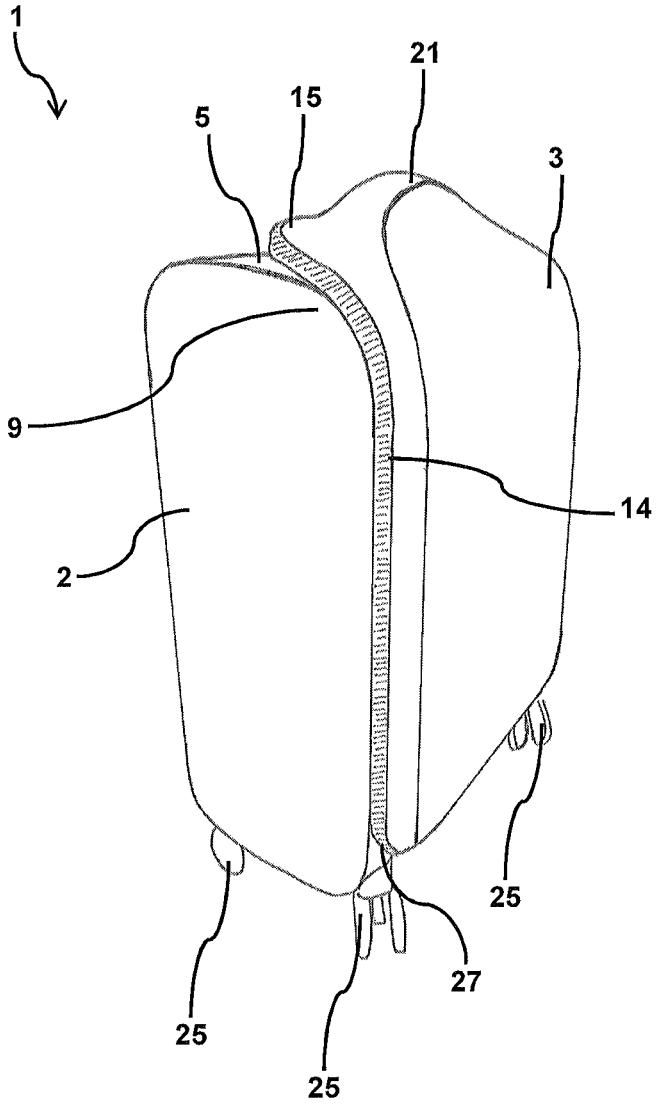
FIG. 9 is a further perspective view of a closed suitcase.

FIGS. 7 and 9 show that it may be advantageous for the lid 3 not to form a plane together with the suitcase body 2 when closed, but instead to rest on said suitcase body such that a step 27 results between the suitcase body 2 and the lid 3. This can increase the luggage space of the suitcase body. The height of the step 27 reduces towards the side wall 5 comprising the recess 12, in that the band half 16 of the zip fastener 14 on the suitcase body 2 tapers towards the upper edge 18. At the corners 9 of the long sides 8, the overlapping segment 15 is substantially in a plane with the integrated reinforcement element and, together with the remaining side wall 5, forms a complete side 7, 8 that protects the suitcase contents.

The invention claimed is:

1. A suitcase comprising a suitcase body that is delimited by a back wall and by side walls that adjoin said back wall and are arranged on two opposing narrow and long sides of the suitcase body in each case, and said suitcase comprising a folding lid that is formed on at least one side of the suitcase body and can be connected to the suitcase body by means of a zip fastener, wherein one side wall comprises a recess on a narrow side in which an overlapping segment of the lid engages such that the overlapping segment forms the side wall of the suitcase body at least in part, wherein the zip fastener comprises two band halves, one band half of the zip fastener extending along an upper edge of the suitcase body that is formed by the side walls and the recess, and a further band half of the zip fastener extending along a lower edge of the lid that is formed by a lid base surface or by the lid base surface and the overlapping segment, wherein at least partially along the band half of the zip fastener in the lid an edge reinforcement made of plastic or metal extends for dimensionally stabilizing the lid, and wherein a carrying handle is formed on the overlapping segment.

2. The suitcase according to claim 1, wherein a limiting element is arranged in the recess.

3. The suitcase according to claim 1, further comprising rounded edges that extend from the narrow or long sides towards the lid and that are curved outwardly.

4. The suitcase according to claim 3, wherein the overlapping segment is curved outwardly so as to correspond geometrically to the rounded edges.

5. The suitcase according to claim 1, wherein a plastics or metal reinforcement that leads onto the carrying handle and surrounds the lid at least in part is provided in the lid.

6. The suitcase according to claim 1, wherein a side wall of the suitcase body is provided as a base structure that is formed by a stabilizing shell and on which casters are provided.

7. The suitcase according to claim 1, wherein the lid is formed on the suitcase body by means of the overlapping segment.

8. The suitcase according to claim 1, wherein a reinforcement element is provided in the overlapping segment.

9. The suitcase according to claim 8, wherein the side wall of the suitcase body that comprises the recess comprises a reinforcement element which forms, together with the reinforcement element provided in the overlapping segment, a reinforcement that substantially completely covers the relevant side of the suitcase body.

* * * * *